United States Patent [19]

Courson et al.

[11] 4,081,141

[45] Mar. 28, 1978

[54] SPRAY BARS FOR METAL ROLLING AND FLOW CONTROL VALVES

[75] Inventors: Richard B. Courson, Grosse Pointe Park; Henry Piontkowski, Warren, both of Mich.

[73] Assignee: Almo Manifold and Tool Company, Centerline, Mich.

[21] Appl. No.: 726,986

[22] Filed: Sep. 27, 1976

[51] Int. Cl.[2] ..... B05B 1/30; B05B 1/14

[52] U.S. Cl. ..... 239/551; 239/585; 251/129; 251/321

[58] Field of Search ..... 239/550, 551, 585, 586; 251/129, 131, 321; 137/454.2

[56] References Cited

U.S. PATENT DOCUMENTS

| | | | |
|---|---|---|---|
| 1,049,153 | 12/1912 | Savino | 251/321 |
| 2,926,691 | 3/1960 | Huff | 251/129 X |
| 3,523,305 | 8/1970 | Zorn | 251/129 X |
| 3,771,730 | 11/1973 | Nicoloff et al. | 239/550 |
| 3,842,809 | 10/1974 | King | 251/129 |
| 3,880,358 | 4/1975 | Schaming | 239/551 |

FOREIGN PATENT DOCUMENTS

| | | | |
|---|---|---|---|
| 1,151,483 | 1/1958 | France | 251/129 |
| 1,016,590 | 9/1957 | Germany | 251/321 |

*Primary Examiner*—Robert W. Saifer
*Attorney, Agent, or Firm*—William L. Fisher

[57] ABSTRACT

Improvement in a spray bar for metal rolling having a body and a plurality of spray nozzles carried thereon, a flow control valve for the spray bar for controlling the flow of liquid through the nozzles, the valve having a valve body and a valve spool reciprocable in the valve body, a liquid passage in the spray bar, the valve arranged in respect to the spray bar so that a portion thereof extends across the passage and liquid enters the valve from the passage, a yieldable member operative upon the valve spool for biasing it into its closed position, the improvement comprising a moveable member arranged in respect to the spray bar for controlling the movement of the valve spool, an arrangement for applying a variable force on the member so that the movement of the valve spool and the flow of liquid through the valve is directly proportional to the amount of force applied to the member, the member disposed at the rear of the spray bar so that the member pushes upon the valve spool for opening the valve, and the center section of the valve body and the center section of the valve spool each being reduced in diameter in relation to the ends of the valve, and the center section of the valve body having apertures therein forming an inlet for liquid entering the valve.

20 Claims, 5 Drawing Figures

SPRAY BARS FOR METAL ROLLING AND FLOW CONTROL VALVES

Our invention relates to liquid spray systems for metal rolling.

The principal object of our invention is the provision of improvements in spray bars for metal rolling by which the flow of liquid therethrough can be controlled.

Figure 1:
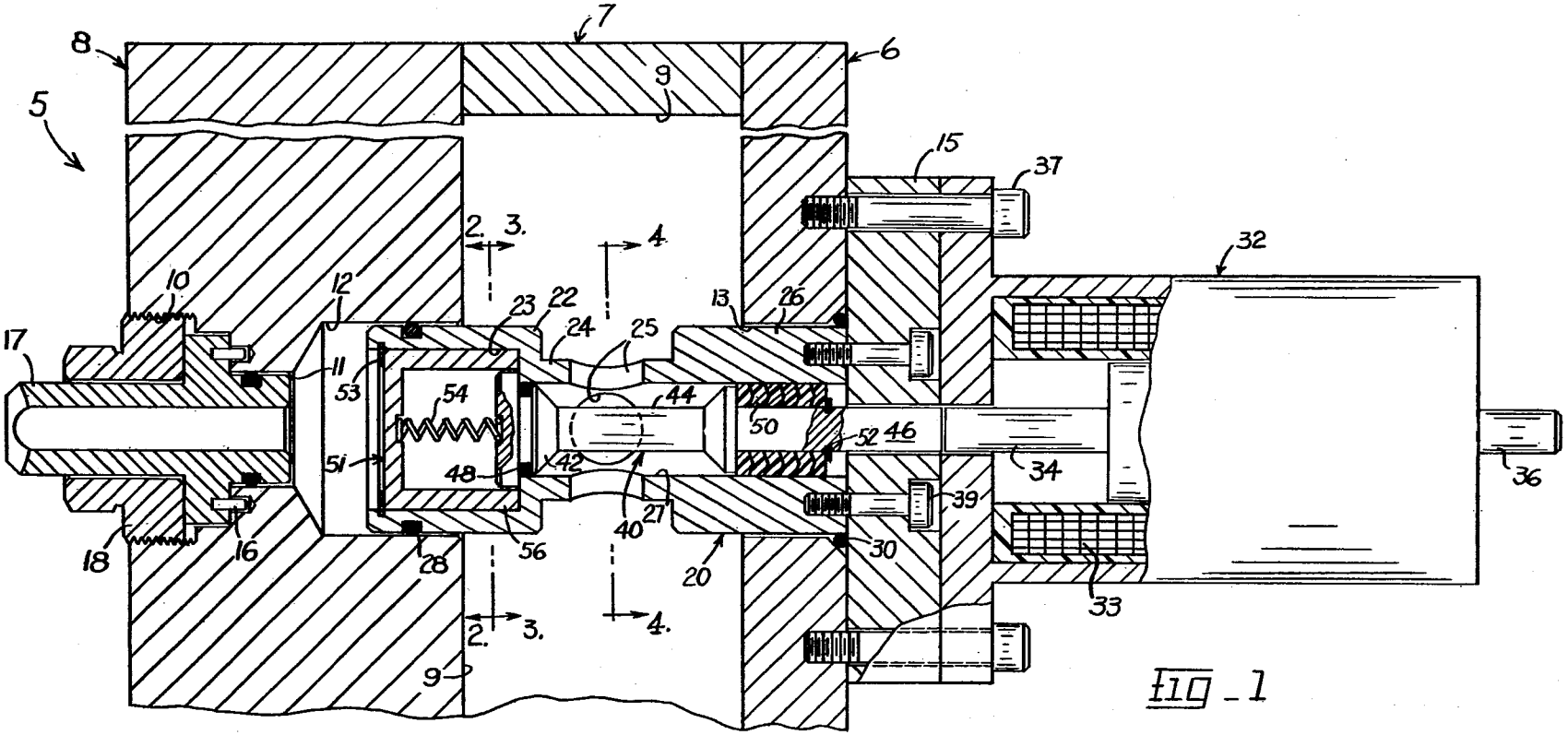
Figure 4:
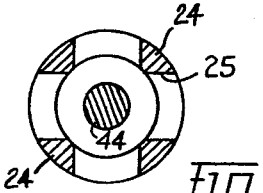
Figure 3:
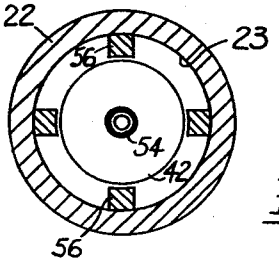
Figure 2:
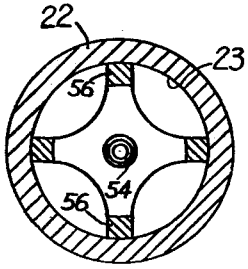
Figure 5:
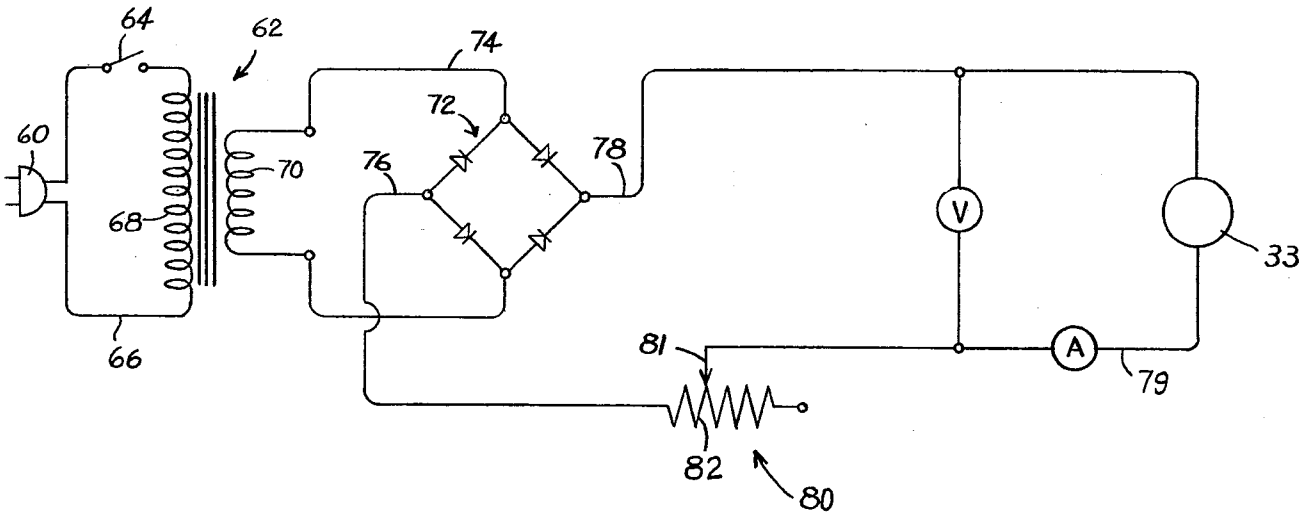

The foregoing object of our invention and the advantages thereof will become apparent during the course of the following description, taken in conjunction with the accompanying drawings, in which:

FIG. 1 is a transverse sectional view of an improved spray bar and flow control valve embodying our invention; and FIGS. 2–4 are longitudinal sectional views of the structure of FIG. 1 taken, respectively, on the lines 2—2, 3—3, and 4—4 thereof.

Referring to the drawings in greater detail, 5 generally designates said spray bar which consists of an elongated body formed of metal layers 6, 7 and 8 bonded together as described in prior U.S. Pat. No. 3,771,730. A liquid passage 9 is formed in the layer 7. Cooling liquid enters the passage 9 through any suitable liquid inlet for said spray bar 5. A plurality of liquid spray nozzles 17 are carried on the front layer 8 and held in apertures 10 and 11 therein. Pins 16 and accommodating slots, therefor, as shown, orientate said nozzles 17 on the spray bar 5. A cover nut 18 for each nozzle 17 is threadably engaged in the threaded aperture 10. A solenoid-operated flow control valve is also carried on said spray bar 5 consisting of a direct current solenoid 32 and a flow control valve 20 bolted together by means of a base plate 15 and bolts 37 and 39. The body of the valve 20 is disposed in apertures 12 and 13 formed in the layers 6 and 8, respectively, and extends across the passage 9. Said valve body consists of sections 22, 24 and 26 in which are formed liquid passages 23 and 27 having an inlet in the form of apertures 25 provided in the center section 24.

A valve spool 40 reciprocates in said passages 23 and 27 and consists of sections 42, 44 and 46. The center section 44 is reduced in diameter to allow liquid to enter the passage 27 from the inlet 25. The front section 42 is enlarged in diameter over the section 44 and a portion thereof operates in the passage 23 to bottom the valve spool 40 in its closed position by abutting the shoulder formed at the junction of said passages 23 and 27. An O-ring 48 carried on said section 42 forms a liquid-tight seal with the passage 27 in the closed position of the valve 20. Said section 42 has a cavity centrally formed therein for holding an end of a compression spring 54, the opposite end of which is held in an oppositely facing cavity centrally formed in a radial wall of a member 51 which serves as a retainer and guide for the valve spool 40. Said member 51 is fastened in the passage 23 by a snap ring 53 and has arms 56 which extend rearwardly from said radial wall for guiding the movement of said front section 42. Said member 51 has openings formed in its radial wall to pass liquid therethrough as shown in FIG. 2 so that liquid entering the inlet 25 passages out the nozzle 17 whenever the valve 20 is open. The rear section 46 of said valve spool 40 is also reduced in diameter and extends rearwardly to engage the plunger 34 of said solenoid 32. The rear end of said rear section 46 extends rearwardly of the rear end of the valve body and into an aperture in the base plate 15 where it abuts the front end of the plunger 34. The base plate 15 serves to bolt to itself the valve body and the flange of the solenoid casing to the rear layer 6. Said section 46 carries a snap ring thereon which is used to hold valve packing 50 compressed against a shoulder formed on said valve spool at the junction of the sections 44 and 46. Said valve packing 50, in this instance, is formed of individual chevron-shaped packing rings of Teflon which have been found to form a good liquid-tight seal with the passage 27 while permitting free movement of the valve spool 34.

The movement of said valve spool 40 is directly proportional to the direct current voltage across the solenoid coil 33 which, when energized, causes the plunger 34 to move in direct proportion to said voltage and push upon the section 46 against the urging of the spring 54. Upon de-energization of the solenoid 32 said spring 54 biases the valve spool 40 into its closed position. A conventional manual override 36, as shown, may be provided for the solenoid 32. Voltage across the coil 33 is controlled, in this instance, by a potentiometer 80 having a moveable tap 81 and and fixed resistance 82. Said potentiometer 80 is in series circuit via electrical lines 78, 76 and 79 with said coil 33 across the output terminals of a full wave bridge rectifier 72, the input terminals of which are connected via electrical line 74 to the secondary 70 of a step-down transformer 62, the primary 68 of which is connected via electrical line 66 and off-on switch 64 to a suitable alternating power source 60.

In operation of said spray bar 5 cooling liquid enters the liquid passage 9 from a liquid inlet which is preferably offset from the valve 20 and aperture 12 such as shown in said U.S. Pat. No. 3,771,730 for the liquid inlet 18 which is shown offset in relation to the liquid passages 19 and 21. The switch 64 is closed and the tap 81 is moved to the desired position so that the source 60, through the transformer 62, produces a pulsating direct current power output across the output terminals of the rectifier 72 and hence across the potentiometer 80 and the coil 33. When sufficient voltage is applied across the coil 33 to open the valve 20, cooling liquid which enters the passage 9 enters the valve body via the inlet 25 and travels along the passages 27 and 23, through the aperture 12 and out the spray bar 5 through the slit in said nozzle 17. The amount of flow through said nozzle 17 is directly proportional to the voltage across said coil 33 which, in this instance, is directly proportional to the movement of the tap 81 on the resistance 82. Said valve 20 can be used to control the liquid flow through a single nozzle 17 as shown or simultaneously through a plurality of nozzles fed from a flow control zone to achieve cubic equality of flow therethrough as shown in said U.S. Pat. No. 3,771,730. Said valve 20 can also be used to control the fluid flow through all of the nozzles on a spray bar or on a plurality of spray bars. Construction of the valve spool 40, particularly the section 42 thereof, in relation to the passages 23 and 27 in the valve body enables the flow through said nozzle 17 to be controlled in fine increments between maximum flow and shut-off. Movement of the tap 81 may be remotely controlled by conventional means. The ammeter A and voltmeter V are provided as shown in respect to the coil 33 so that readings or signals therefrom can be fed to a computer for computer programming the fluid flow through the spray nozzles which is a significant advantage considering the complexities involved in proper cooling of the metal sheets in a metal rolling mill.

It will thus be seen that there has been provided by our invention improvements in spray bars in which the object hereinabove set forth, together with many thoroughly practical advantages, has been achieved. While a preferred embodiment of our invention has been shown and described, it is to be understood that variations and changes may be resorted to without departing from the spirit of our invention as defined by the appended claims.

What we claim is:

1. Improvement in a spray bar for metal rolling having a body and a plurality of spray nozzles carried thereon, a flow control valve for said spray bar for controlling the flow of liquid through said nozzles, said valve having a valve body and a valve spool reciprocable in said valve body, a liquid passage in said spray bar, said valve arranged in respect to said spray bar so that a portion thereof extends across said passage and liquid enters said valve from said passage, yieldable means operative upon said valve spool for biasing it into its closed position, said improvement comprising a moveable member for said spray bar for controlling the movement of said valve spool, means for applying a variable force on said member so that the movement of said valve spool and the flow of liquid through said valve is directly proportional to the amount of force applied to said member, said member disposed at the rear of said spray bar so that said member pushes upon said valve spool for opening said valve, and the center section of said valve body and the center section of said valve spool each being reduced in diameter in relation to the ends of said valve, and the center section of said valve body having apertures therein forming an inlet for liquid entering said valve.

2. Improvement in a spray bar for metal rolling having a layered body and a plurality of spray nozzles carried thereon, a flow control valve for said spray bar for controlling the flow of liquid through said nozzles, said valve having a valve body and a valve spool reciprocable in said valve body, a liquid passage in said spray bar, said valve arranged in respect to said spray bar so that a portion thereof extends across said passage and liquid enters said valve from said passage, yieldable means operative upon said valve spool for biasing it into its closed position, said improvement comprising a direct current solenoid for said spray bar for controlling the movement of said valve spool, and means for applying a variable direct current voltage across said solenoid so that the movement of said valve spool and the flow of fluid through said valve is directly proportional to the amount of voltage across said solenoid, the center section of said valve body and the center section of said valve spool each being reduced in diameter in relation to the ends of said valve, and the center section of said valve body having apertures therein forming an inlet for liquid entering said valve.

3. Improvement as claimed in claim 2, a retainer fastened in the front end of said valve body, said yieldable means being a compression spring disposed between said retainer and the front end of said valve spool, said front end of said valve spool carrying liquid-tight seal means thereon operative in the close position of said valve.

4. Improvement as claimed in claim 3, said retainer having means thereon for guiding the movement of the front end of said valve spool.

5. Improvement as claimed in claim 4, a shoulder formed in the front end of said valve body, the front end of said valve spool bottoming against said shoulder in the close position of said valve.

6. Improvement as claimed in claim 5, the rear end of said valve spool carrying valve packing thereon, said packing operative in both the close and open positions of said valve to form a liquid-tight seal with said valve body.

7. Improvement as claimed in claim 6, the rear end of said valve spool having a shoulder formed thereon, said packing being individual chevron-shaped plastic packing rings, and means on the rear end of said valve spool for compressing said rings against said shoulder.

8. Improvement as claimed in claim 2, a base plate for bolting said valve body to said spray bar and having an aperture therein, the rear end of said valve spool extending rearwardly of the rear end of said valve body and into the aperture in said base plate.

9. Improvement as claimed in claim 8, the casing for said solenoid having a flange thereon, and means for bolting said flange and said base plate together and to the rear layer of said spray bar.

10. Improvement as claimed in claim 2, said means for varying the voltage across said solenoid including rectifier means and variable resistance means in series with said solenoid across said rectifier means.

11. Improvement in a flow control valve for controlling fluid flow, said valve having a valve body and a valve spool reciprocable in said valve body, yieldable means operative upon said valve spool for biasing it into its closed position, said improvement comprising a moveable member for controlling the movement of said valve spool, means for applying a variable force on said member so that the movement of said valve spool and the flow of fluid through said valve is directly proportional to the amount of force applied to said member, a base plate for said valve body made fast to the rear face thereof, said member arranged in relation to said base plate so that said member pushes upon said valve spool for opening said valve, the center section of said valve body and the center section of said valve spool each being reduced in diameter in relation to the ends of said valve, and the center section of said valve body having apertures therein forming an inlet for fluid entering said valve.

12. Improvement in a flow control valve for controlling fluid flow, said valve having a valve body and a valve spool reciprocable in said valve body, yieldable means operative upon said valve spool for biasing it into its closed position, said improvement comprising a direct current solenoid for controlling the movement of said valve spool, means for applying a variable direct current voltage across said solenoid so that the movement of said valve spool and the flow of fluid through said valve is directly proportional to the amount of voltage across said solenoid, a base plate for said valve body made fast to the rear face thereof, said solenoid arranged in respect to the rear face of said base plate so that the plunger thereof pushes upon said valve spool for opening said valve, the center section of said valve body and the center section of said valve spool each being reduced in diameter in relation to the ends of said valve, and the center section of said valve body having apertures therein forming an inlet for fluid entering said valve.

13. Improvement as claimed in claim 12, a retainer fastened in the front end of said valve body, said yieldable means being a compression spring disposed between said retainer and the front end of said valve spool, said front end of said valve spool carrying liquid-tight seal means thereon operative in the close position of said valve.

14. Improvement as claimed in claim 13, said retainer having means thereon for guiding the movement of the front end of said valve spool.

15. Improvement as claimed in claim 14, a shoulder formed in the front end of said valve body, the front end of said valve spool bottoming against said shoulder in the close position of said valve.

16. Improvement as claimed in claim 15, the rear end of said valve spool carrying packing thereon, said packing operative in both the close and open positions of said valve to form a liquid-tight seal with said valve body.

17. Improvement as claimed in claim 16, the rear end of said valve spool having a shoulder formed thereon, said packing being individual chevron-shaped plastic packing rings, and means on the rear end of said valve spool for compressing said rings against said shoulder.

18. Improvement as claimed in claim 12, said base plate having an aperture therein, the rear end of said valve spool extending rearwardly of the rear end of said valve body and into the aperture in said base plate.

19. Improvement as claimed in claim 18, the casing for said solenoid having a flange thereon, and means for bolting said flange and said base plate together.

20. Improvement as claimed in claim 12, said means for varying the voltage across said solenoid including rectifier means and variable resistance means in series with said solenoid across said rectifier means.

* * * * *